US011084675B2

(12) United States Patent
Hamada

(10) Patent No.: US 11,084,675 B2
(45) Date of Patent: Aug. 10, 2021

(54) PAPER CONVEYANCE DEVICE AND METHOD OF CONTROLLING PAPER CONVEYANCE DEVICE

(71) Applicant: KYOCERA Document Solutions Inc., Osaka (JP)

(72) Inventor: Takuya Hamada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 191 days.

(21) Appl. No.: 16/443,599

(22) Filed: Jun. 17, 2019

(65) Prior Publication Data

US 2019/0389679 A1 Dec. 26, 2019

(30) Foreign Application Priority Data

Jun. 26, 2018 (JP) ..... JP2018-120467

(51) Int. Cl.

| | |
|---|---|
| ***B65H 7/12*** | (2006.01) |
| ***B65H 7/02*** | (2006.01) |
| ***B65H 7/20*** | (2006.01) |
| ***B41J 13/00*** | (2006.01) |
| ***B41J 13/10*** | (2006.01) |

(52) U.S. Cl.

CPC ..... *B65H 7/02* (2013.01); *B41J 13/0018* (2013.01); *B41J 13/103* (2013.01); *B65H 7/20* (2013.01); *B65H 2553/26* (2013.01); *B65H 2553/30* (2013.01); *B65H 2557/112* (2013.01); *B65H 2557/242* (2013.01); *B65H 2557/64* (2013.01)

(58) Field of Classification Search

CPC . B65H 7/125; B65H 7/12; B65H 7/02; B65H 7/20; B65H 2553/30; B65H 2557/64; B65H 2557/242; B65H 2557/112; B65H 2511/11; B65H 2511/13; B65H 2513/514

See application file for complete search history.

(56) References Cited

U.S. PATENT DOCUMENTS 7,270,325 B2 * 9/2007 Sano ..... B65H 7/125 271/262
7,819,400 B2 * 10/2010 Miyoshii ..... B65H 7/12 271/265.04

(Continued)

FOREIGN PATENT DOCUMENTS

| | | |
|---|---|---|
| CN | 1625208 A | 6/2005 |
| CN | 1626421 A | 6/2005 |
| JP | 2017-30881 A | 2/2017 |

OTHER PUBLICATIONS

Chinese Office Action dated Mar. 26, 2021, issued by the China National Intellectual Property Administration in corresponding application CN 201910553715.2.

*Primary Examiner* — Luis A Gonzalez
(74) *Attorney, Agent, or Firm* — Stein IP, LLC

(57) ABSTRACT

A paper conveyance device includes a paper feed unit, a conveyance rotator, a conveyance guide, a multi-feed detection unit, and a control unit. The control unit causes an ultrasonic sensor to transmit an ultrasonic wave in a detection section. The control unit sets a detection execution section and a detection skip section in the detection section. The control unit does not determine whether multi-feed has occurred in the detection skip section. The control unit sets the detection skip section based on a time point at which vibration is applied to conveyed paper.

16 Claims, 10 Drawing Sheets

(56) References Cited

U.S. PATENT DOCUMENTS

| | | | | |
|---|---|---|---|---|
| 8,684,356 | B2 * | 4/2014 | Fukusaka | B65H 7/02 271/265.03 |
| 10,815,088 | B2 * | 10/2020 | Okazaki | G01N 29/4427 |
| 2005/0127597 | A1 * | 6/2005 | Sano | B65H 7/125 271/258.01 |
| 2005/0184453 | A1 | 8/2005 | Sano et al. | 271/262 |
| 2007/0018376 | A1 | 1/2007 | Sano et al. | 271/10.01 |
| 2020/0361730 | A1 * | 11/2020 | Kusumi | B65H 7/125 |

* cited by examiner

| PAPER TYPE | BASIS WEIGHT (g/m$^2$) |
|---|---|
| THIN PAPER | LESS THAN 50 |
| PLAIN PAPER | 50 OR MORE BUT LESS THAN 100 |
| THICK PAPER 1 | 100 OR MORE BUT LESS THAN 200 |
| THICK PAPER 2 | 200 OR MORE |

L1

PAPER CONVEYANCE DEVICE AND METHOD OF CONTROLLING PAPER CONVEYANCE DEVICE

CROSS-REFERENCE TO RELATED APPLICATIONS

This application claims the benefit of priority under Japanese Patent Application No. 2018-120467 filed on Jun. 26, 2018, the contents of which are incorporated herein by reference.

BACKGROUND

The present disclosure relates to a paper conveyance device that detects multi-feed of paper using an ultrasonic sensor.

There is a device that conveys paper and executes a job. Examples of such devices include an image forming device. The image forming device is, for example, a multifunction peripheral, a printer, a copier, and a FAX device. The image forming device may convey a plurality of overlapped sheets of paper (multi-feed). Multi-feed of paper can cause a paper jam. Further, contents of one page may be printed over a plurality of sheets of paper. In this way, when multi-feed occurs, proper printing may not be possible. One example of techniques to detect multi-feed of paper as follows is known.

Specifically, there is known a sheet conveyance device wherein: transmits an ultrasonic wave, receives an ultrasonic signal, conveys a sheet between the transmitted ultrasonic waves, detects multi-feed in which a plurality of overlapped sheets based on a reception level of the ultrasonic signal received while the sheet is passing between the ultrasonic waves, executes multi-feed detection a plurality of times and controls execution timing of the multi-feed detection so that the last multi-feed detection among the multi-feed detections executed the plurality of times, is executed in an upstream-side end section in a paper conveyance direction that is a section from the upstream-side end in the paper conveyance direction of the sheet to a position separated by a predetermined distance in the paper conveyance direction of the sheet.

An ultrasonic sensor may be used for detection of multi-feed of paper. The ultrasonic sensor includes a transmission circuit and a reception circuit. The transmission circuit transmits an ultrasonic wave. The reception circuit outputs a voltage corresponding to the level of the received ultrasonic wave. Paper passes between the transmission circuit and the reception circuit. The amount (intensity) of the ultrasonic wave received by the reception circuit when multi-feed is occurring is lower than that when multi-feed is not occurring. When multi-feed is occurring, the output level of the reception circuit is lower. Based on the output level of the reception circuit, it is determined whether multi-feed has occurred.

Here, vibration (shock) may be applied to the paper while the paper is passing between the transmission circuit and the reception circuit. This vibration may cancel the ultrasonic wave. Even if only one sheet of paper is being conveyed, the output level of the reception circuit may temporarily decrease due to vibration applied to the paper. There is a problem in that false detection of multi-feed may occur due to vibration applied to the paper. In the publicly known technique described above, vibration applied to the paper is not taken into consideration. It is not possible to cope with false detection of multi-feed due to vibration on the paper.

SUMMARY

The paper conveyance device according to an aspect of the present disclosure includes a paper feed unit, a conveyance rotator, a conveyance guide, a multi-feed detection unit, and a control unit. The paper feed unit accommodates and supplies paper. The conveyance rotator conveys the paper. The conveyance guide guides the conveyed paper. The multi-feed detection unit includes an ultrasonic sensor and a charge circuit. A detection voltage that is an output of the multi-feed detection unit is input into the control unit. The ultrasonic sensor includes a transmission unit and a reception unit. The transmission unit transmits an ultrasonic wave. The reception unit outputs an electric charge corresponding to the level of the received ultrasonic wave. The transmission unit and the reception unit are provided on a paper conveyance path so that the paper is conveyed between the transmission unit and the reception unit. The charge circuit outputs, as the detection voltage, a voltage obtained by storing the electric charge output by the reception unit. The control unit sets, for each sheet of conveyed paper, a detection section in which the transmission unit is caused to transmit an ultrasonic wave. In the detection section, the control unit causes the transmission unit to transmit an ultrasonic wave of a predetermined cycle. The control unit sets a detection execution section and a detection skip section in the detection section. In the detection execution section, the control unit determines whether multi-feed is occurring based on the detection voltage. In the detection skip section, the control unit does not determine whether multi-feed has occurred based on the detection voltage. The control unit sets the detection skip section based on a time point at which vibration is applied to the conveyed paper.

Further features and advantages of the present disclosure will become more apparent by the embodiment described below.

DETAILED DESCRIPTION

The present disclosure accurately determines whether multi-feed has occurred in consideration of vibration applied to paper. Hereinafter, an embodiment of the present disclosure will be described with reference to FIGS. 1 to 14. In the present description, a multifunction peripheral 100 will be described as an example of a paper conveyance device. The multifunction peripheral 100 conveys paper and prints on the paper. The multifunction peripheral 100 is also an image forming device. Each element such as the configuration and the arrangement described hereinafter in the description of the present embodiment is merely an explanatory example that does not limit the scope of the disclosure.

(Multifunction Peripheral 100)

Figure 1:
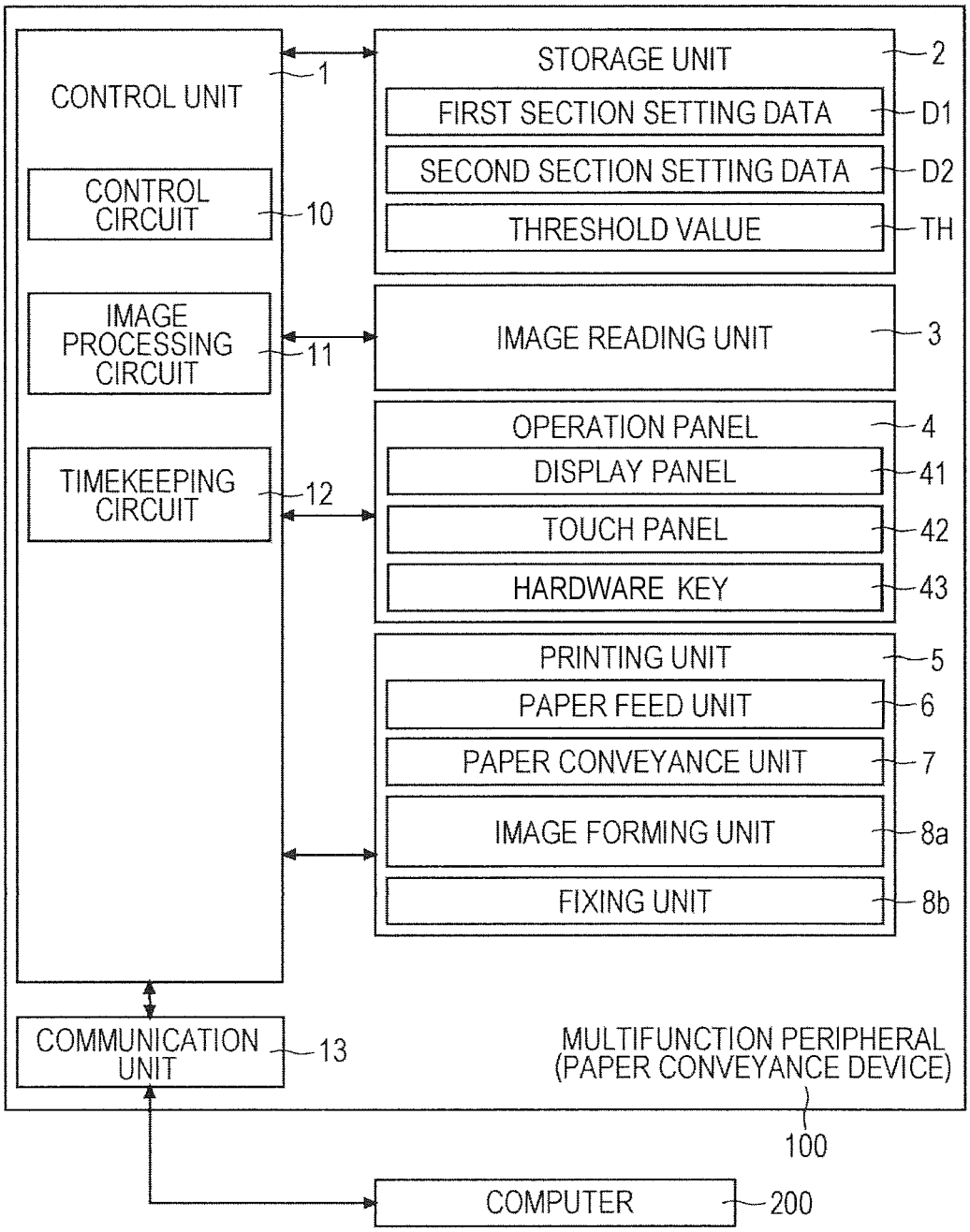
FIG. 1 is an explanatory diagram showing an example of an image forming device according to an embodiment.

First, an example of the multifunction peripheral 100 according to the embodiment will be described with reference to FIG. 1. As shown in FIG. 1, the multifunction peripheral 100 includes a control unit 1 and a storage unit 2. The control unit 1 controls each unit of the multifunction peripheral 100. The control unit 1 includes a control circuit 10 and an image processing circuit 11. The control circuit 10 is, for example, a central processing unit (CPU). The control circuit 10 performs calculation and processing related to control. The image processing circuit 11 is, for example, an application specific integrated circuit (ASIC). The image processing circuit 11 processes image data. The storage unit 2 includes storage devices such as a read-only memory (ROM), a random access memory (RAM), and a hard disk drive (HDD). The storage unit 2 stores a control program and various kinds of data.

The multifunction peripheral 100 includes an image reading unit 3. The image reading unit 3 reads an original document having been set. The image reading unit 3 generates image data of the original document. The image data of the original document is used as image data for printing.

The multifunction peripheral 100 includes an operation panel 4. The control unit 1 is communicably connected with the operation panel 4. The operation panel 4 includes a display panel 41, a touch panel 42, and a hardware key 43 (a start key, for example). The control unit 1 controls display on the display panel 41. The control unit 1 causes the display panel 41 to display a screen and an image. For example, the control unit 1 displays an operation image. The operation image is, for example, a software key or a button. Based on an output of the touch panel 42, the control unit 1 recognizes the operation image having been operated. Further, the control unit 1 recognizes the hardware key 43 having been operated. In this way, the operation panel 4 accepts an operation of a user. The control unit 1 recognizes a content of a setting operation performed on the operation panel 4. Furthermore, in response to the operation image and the hardware key 43 having been operated, the control unit 1 causes the display panel 41 to switch display contents. The control unit 1 controls the multifunction peripheral 100 such that the multifunction peripheral 100 operates as has been set.

The multifunction peripheral 100 includes a printing unit 5. The printing unit 5 includes a paper feed unit 6, a paper conveyance unit 7, an image forming unit 8*a*, and a fixing unit 8*b*. In a print job, the control unit 1 causes the paper feed unit 6 to supply paper sheet by sheet. The control unit 1 causes the paper conveyance unit 7 to convey the paper. The control unit 1 causes the image forming unit 8*a* to form, using toner, a toner image based on the image data for printing. The control unit 1 causes the image forming unit 8*a* to transfer the toner image to the conveyed paper. The control unit 1 causes the fixing unit 8*b* to fix the toner image on the paper. The paper conveyance unit 7 discharges the printed paper to a discharge tray.

The multifunction peripheral 100 includes a communication unit 13. The communication unit 13 includes a communication connector, a communication circuit, and a communication memory. The communication unit 13 communicates with a computer 200. The computer 200 is, for example, a personal computer (PC) or a server. The communication unit 13 can transmit and receive data to and from the computer 200.

(Paper Conveyance)

Figure 2:
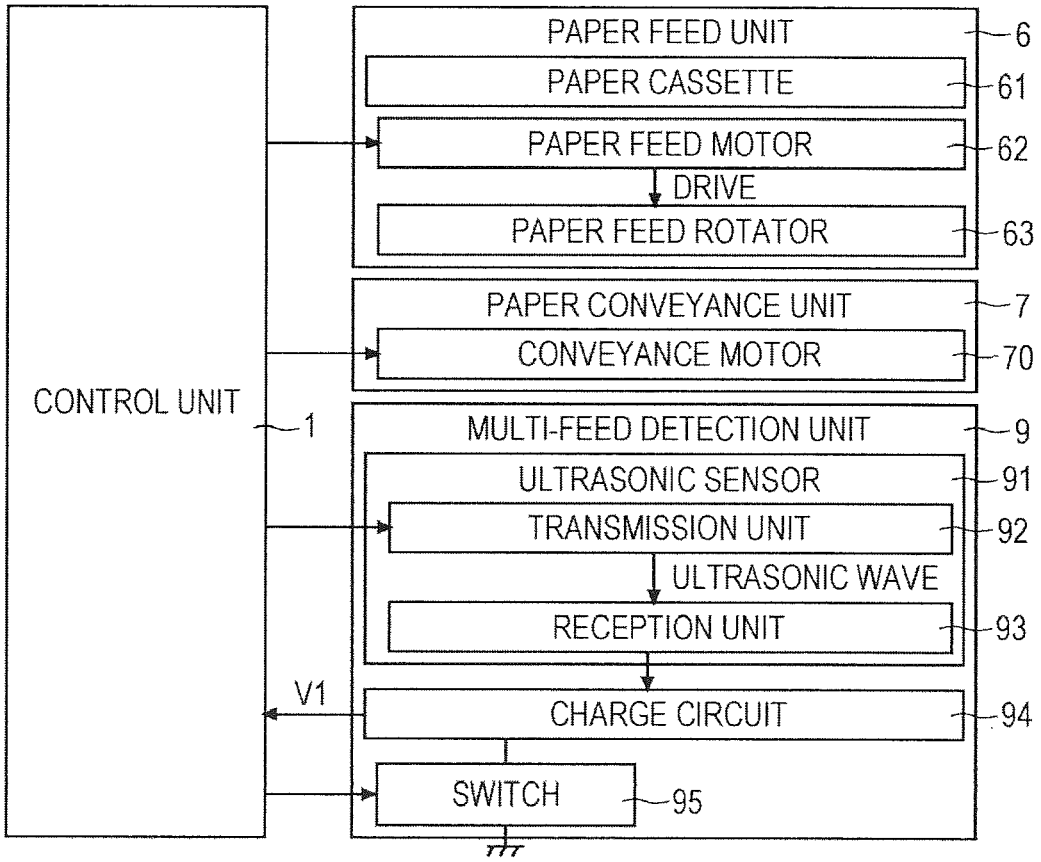
FIG. 2 is a diagram showing an example of a paper conveyance-related portion in a multifunction peripheral according to the embodiment.

An example of a portion related to paper conveyance in the multifunction peripheral 100 according to the embodiment will be described with reference to FIGS. 2 and 3. The multifunction peripheral 100 includes the paper feed unit 6 and the paper conveyance unit 7. As shown in FIG. 2, the paper feed unit 6 includes a paper cassette 61, a paper feed motor 62, and a paper feed rotator 63 (pickup roller). The paper cassette 61 accommodates a bundle of sheets of paper. The paper feed rotator 63 is in contact with the paper accommodated. By the drive of the paper feed motor 62, the paper feed rotator 63 rotates. By the rotation of the paper feed rotator 63, the paper is sent out from the paper cassette 61. At the time of a print job, the control unit 1 rotates the paper feed motor 62. At the time of consecutive printing of a plurality of sheets of paper, the control unit 1 causes the paper feed motor 62 to repeat rotation and temporary stop. A predetermined paper interval is provided between the sheets of paper.

The paper sent out from the paper feed unit 6 enters the paper conveyance unit 7. As shown in FIG. 3, the paper conveyance unit 7 includes a conveyance rotator 71 and a conveyance guide 74. The conveyance rotator 71 rotates to convey the paper. The conveyance guide 74 guides the conveyed paper. FIG. 3 shows an example of a portion of the paper conveyance unit 7 in which the paper is conveyed from bottom (paper feed unit 6) to top (image forming unit 8*a*). In FIG. 3, the lower conveyance rotator 71 is a pair of intermediate rollers 72. In FIG. 3, the upper conveyance rotator 71 is a pair of registration rollers 73.

The paper conveyance unit 7 includes one or more conveyance motors 70. One or more conveyance rotators 71 rotate by the drive of the conveyance motor 70. By the rotation of the conveyance rotator 71, the paper is conveyed. The paper passes through a conveyance path formed by the conveyance guide 74. At the time of a print job, the control unit 1 rotates the conveyance motor 70.

(Multi-Feed Detection Unit 9)

Next, an example of a multi-feed detection unit 9 included in the multifunction peripheral 100 according to the embodiment will be described with reference to FIGS. 2 and 3. Multi-feed (conveyance of overlapped sheets of paper) may occur. For example, a part of one sheet of paper may overlap a part of the next sheet of paper when conveyed. In some cases, multi-feed may occur by sheets of paper being fed in series. Two sheets of paper that are almost completely overlapped may also be conveyed.

A paper jam may occur due to multi-feed. Further, when the paper reaches the image forming unit 8*a* in a multi-feed state, the content of one page is printed across a plurality of sheets of paper. Unnecessary printing is performed. At the time of occurrence of multi-feed, the conveyance rotator 71 (conveyance motor 70) should be stopped promptly. In order to detect multi-feed, the multifunction peripheral 100 includes the multi-feed detection unit 9.

The multi-feed detection unit 9 includes an ultrasonic sensor 91, a charge circuit 94, and a switch 95. The ultrasonic sensor 91 includes a transmission unit 92 and a reception unit 93. The transmission unit 92 and the reception unit 93 include a piezoelectric element. When performing multi-feed detection, the control unit 1 inputs a pulse of a predetermined cycle (frequency) to the transmission unit 92. For example, a pulse of several ten to several hundred hertz is input to the transmission unit 92. The application of voltage (pulse) deforms the piezoelectric element. As a result, the transmission unit 92 can transmit an ultrasonic wave having the frequency of the pulse having been input.

The reception unit 93 receives the ultrasonic wave radiated from the transmission unit 92. The piezoelectric element of the reception unit 93 outputs an electric charge (voltage) corresponding to the intensity of the ultrasonic pressure (sound pressure). Note that the reception unit 93 may include an amplifier circuit that amplifies the output of the piezoelectric element. In other words, the reception unit 93 may output the voltage (electric charge) calculated by amplifying the output of the piezoelectric element.

Figure 3:
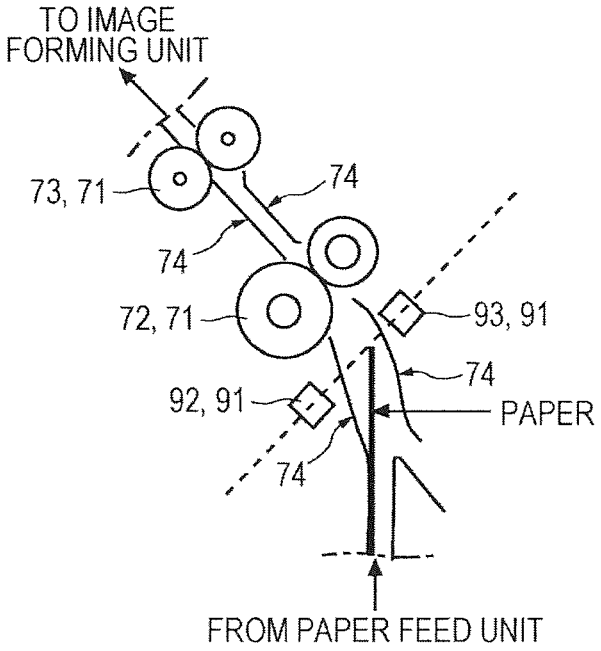
FIG. 3 is a view showing an example of the paper conveyance-related portion in the multifunction peripheral according to the embodiment.

As shown in FIG. 3, the transmission unit 92 and the reception unit 93 are provided so as to sandwich the conveyed paper. An ultrasonic wave transmission surface of the transmission unit 92 faces an ultrasonic wave reception surface of the reception unit 93. The paper passes between the transmission unit 92 and the reception unit 93. The ultrasonic sensor 91 is provided on the upstream side of the image forming unit 8*a* in the paper conveyance direction in order to stop the paper conveyance before the toner image is transferred (before the paper reaches the image forming unit 8*a*). FIG. 3 shows an example in which the ultrasonic sensor 91 is provided between the paper feed unit 6 and the image forming unit 8*a* in the paper conveyance path.

The charge circuit 94 is a circuit that is charged with the output (electric charge) of the reception unit 93 is charged. The charge circuit 94 includes a capacitor. The capacitor is charged with the electric charge. During charging, each time the reception unit 93 outputs a pulse upon reception of an ultrasonic wave, the voltage between the terminals of the capacitor increases. The voltage based on the electric charge stored in the capacitor is input to the control unit 1 as a detection voltage V1 (the voltage at the input-side terminal of the capacitor).

The control unit 1 performs analog-to-digital (ND) conversion on the detection voltage V1 having been input, and recognizes the magnitude of the detection voltage V1. Note that an A/D conversion circuit may be provided in the multi-feed detection unit 9. In this case, the A/D conversion circuit generates digital data indicating the magnitude of the detection voltage V1. The digital data generated by the A/D conversion circuit is input to the control unit 1. The control unit 1 recognizes the magnitude of the detection voltage V1 based on the digital data having been input.

The switch 95 is provided for the charge circuit 94. The switch 95 is a switch for removing the electric charge of the charge circuit 94. The control unit 1 controls the switch 95 (ON/OFF). When removing the charge of the charge circuit 94, the control unit 1 turns on the switch 95. When the switch 95 is turned on, for example, a capacitor (terminal of the capacitor receiving the output of the reception unit 93) is connected to the ground. As a result, discharge is performed. When charging the charge circuit 94, the control unit 1 turns off the switch 95. For example, when the switch 95 is turned off, the connection between the capacitor (terminal of the capacitor receiving the output of the reception unit 93) and the ground is canceled. As a result, charging is performed.

(Flow of Multi-Feed Detection Processing)

Figure 4:
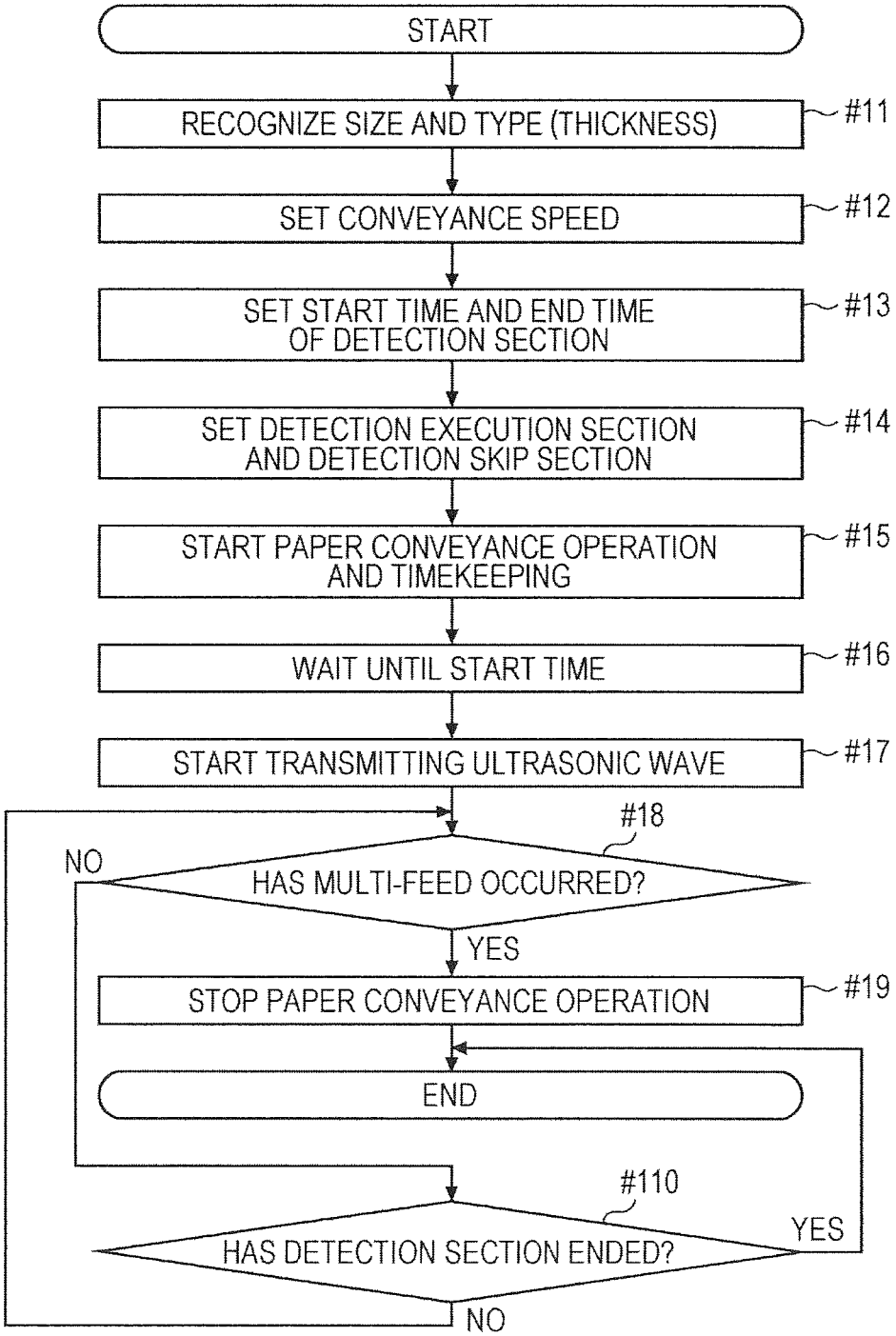
FIG. 4 is a diagram showing an example of multi-feed detection processing of the multifunction peripheral according to the embodiment.

Next, an example of multi-feed detection processing of the multifunction peripheral 100 according to the embodiment will be described with reference to FIGS. 4 to 7. In FIG. 4, "START" is a time point to start a print job. For example, it is a time point to start a copy job or a print job. In the case of a copy job, it is the time point at which the start button of the operation panel 4 is operated. In the case of a print job, it is the time point at which printing data is received from the computer 200. There are cases where multiple pages are executed consecutively. In this case, the processing of FIG. 4 is executed for each page.

Figures 5, 6:
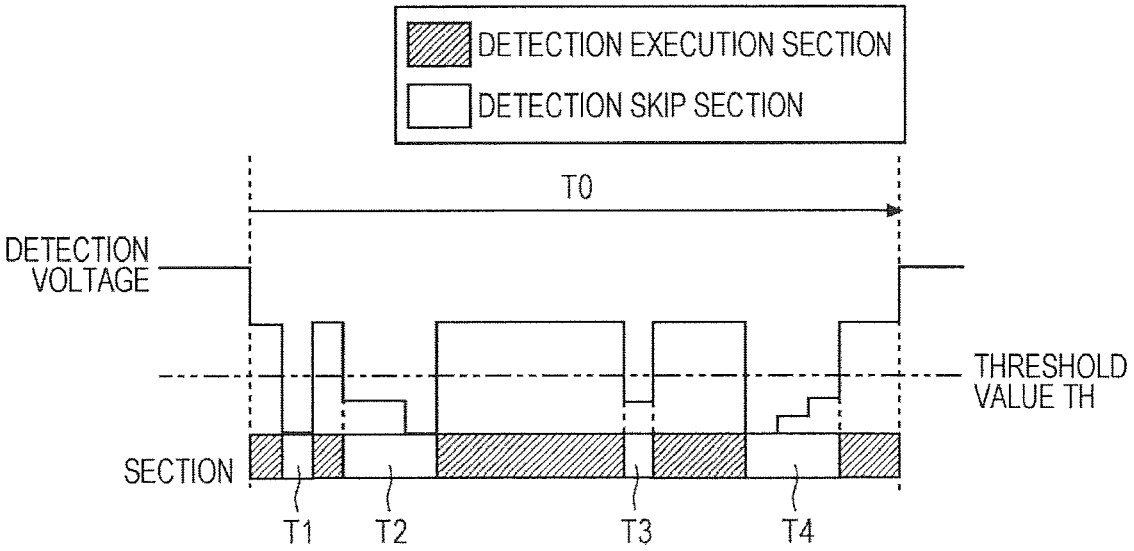
FIG. 5 is a table showing an example of a paper type classification table in the multifunction peripheral according to the embodiment.
FIG. 6 is a chart showing an example of section setting in the multi-feed detection processing according to the embodiment.

The control unit 1 recognizes the size and type (thickness) of the paper used for printing (Step #11). The size and type of paper are set in advance on the operation panel 4. The paper size can be selected from the standard sizes. The thickness can be selected from multiple levels. FIG. 5 shows an example of a paper type classification table L1. The basis weight (gram/square meter) in FIG. 5 indicates the weight of the paper per square meter. For example, commonly distributed office paper is plain paper. Envelopes and postcards are either thick paper 1 or thick paper 2. The user selects the paper type corresponding to the paper loaded in the paper cassette 61. The operation panel 4 accepts selection of the paper size and any of four levels (types), i.e., thin paper, plain paper, thick paper 1, and thick paper 2.

The control unit 1 causes the storage unit 2 to store the size and type of paper set on the operation panel 4. The control unit 1 recognizes the size and type of paper with reference to the data in the storage unit 2. A sensor to detect the size and thickness may be provided in the paper cassette 61. In this case, the control unit 1 recognizes the size and type of paper based on the output of these sensors.

The control unit 1 determines the paper conveyance speed (Step #12). For example, a first conveyance speed (normal conveyance speed) and a second conveyance speed are determined in advance as the paper conveyance speed. For example, the second conveyance speed is set to ½ (half speed) of the first conveyance speed. The operation panel 4 accepts selection of the conveyance speed. At the time of printing, the control unit 1 causes the paper to be conveyed at the selected paper conveyance speed.

The control unit 1 sets the start time and the end time of a detection section T0 by the multi-feed detection unit 9 (Step #13). The start time and the end time of the detection section T0 are set as the time from a predetermined timekeeping start time point. The time point at which the start time has elapsed from the timekeeping start time point is the start time point of the detection section T0. The time point at which the end time has elapsed from the timekeeping start time point is the end time point of the detection section T0.

The storage unit 2 stores first section setting data D1 (see FIG. 1). The first section setting data D1 is data in which the start time and the end time of the detection section T0 are defined for each combination pattern (type) of the paper conveyance speed and the paper size. The control unit 1 sets the start time and the end time of the detection section T0 based on the first section setting data D1.

For example, the first section setting data D1 defines the start time in a case where the paper is conveyed at the first conveyance speed. For example, time calculated by dividing the distance from the paper feed unit 6 (position of the downstream end portion of the paper in the paper cassette 61 in the paper conveyance direction) to the installation position of the ultrasonic sensor 91 by the first conveyance speed is defined as the start time of the detection section T0. In the first section setting data D1, the end time in the case where the paper is conveyed at the first conveyance speed is also defined. For example, time calculated by adding, to the start time, time calculated by dividing the length of the paper in the conveyance direction by the first conveyance speed is defined as the end time of the detection section T0. The length in the conveyance direction varies for each paper size. For this reason, the end time of the detection section T0 is determined for each paper size.

In the first section setting data D1, the start time in a case where the paper is conveyed at the second conveyance speed is defined. For example, time calculated by dividing the distance from the paper feed unit 6 (position of the downstream end portion of the paper in the paper cassette 61 in the paper conveyance direction) to the installation position of the ultrasonic sensor 91 by the second conveyance speed is defined as the start time of the detection section T0. In the first section setting data D1, the end time in the case where the paper is conveyed at the second conveyance speed is also defined. For example, time calculated by adding, to the start time, time calculated by dividing the length of the paper in the conveyance direction by the second conveyance speed is defined as the end time of the detection section T0. The length in the conveyance direction varies for each paper size. For this reason, the end time of the detection section T0 is determined for each paper size.

The control unit 1 sets the detection execution section and the detection skip section in the detection section T0 (Step #14). In other words, the control unit 1 classifies the time in the detection section T0 into one of the detection execution section and the detection skip section. In the detection execution section, the control unit 1 determines whether multi-feed is occurring based on the detection voltage V1. In the detection skip section, the control unit 1 does not determine whether multi-feed has occurred based on the detection voltage V1.

The storage unit 2 stores second section setting data D2 (see FIG. 1). The second section setting data D2 is data in which the start time and the end time of the detection skip section are defined for each combination pattern (type) of the paper conveyance speed, the paper size, and the paper type. A time period that is not the detection skip section becomes the detection execution section. Note that the second section setting data D2 may be data in which the start time and the end time of the detection execution section are defined for each combination pattern (type) of the paper conveyance speed, the paper size, and the paper type. In this case, a time period that is not the detection execution section becomes the detection skip section. Details of setting of the detection execution section and the detection skip section will be described later.

FIG. 6 is a chart showing an example of the detection execution section and the detection skip section set in the detection section T0. The uppermost arrow in FIG. 6 indicates the entire detection section T0. In FIG. 6, the time periods indicated by the hatched rectangles are the detection execution sections. The time periods indicated by the unhatched rectangles are the detection skip sections.

Here, the control unit 1 does not include the start time point of the detection section T0 (time point at which the start time has elapsed from the timekeeping start time point) and the end time point of the detection section T0 (time point at which the end time has elapsed from the timekeeping start time point) in the detection skip section. The control unit 1 typically designates, as the detection execution section, a period until a predetermined time has elapsed after the start time has elapsed from the timekeeping start time point. In addition, the control unit 1 typically designates, as the detection execution section, a period from a predetermined time before the end time point of the detection section T0 to the end time point of the detection section T0. In this way, it is made possible to detect an accompaniment multi-feed. The accompaniment multi-feed is multi-feed in which the tail end portion of one sheet of paper and the front end portion of the next sheet of paper overlap. If the start time and the end time of the detection section T0 are included in the detection skip section, it may be impossible to detect the accompaniment multi-feed in some cases.

The control unit 1 starts timekeeping upon the start of a paper conveyance operation (Step #15). By starting the paper conveyance operation, the control unit 1 starts rotation of the paper feed motor 62 and the conveyance motor 70. As a result, paper feed by the paper feed unit 6 and conveyance by the paper conveyance unit 7 are started. For the purpose of timekeeping, the control unit 1 also includes a timekeeping circuit 12 (timer) (see FIG. 1). The start time of the print operation and timekeeping of Step #15 is the predetermined timekeeping start time point described above.

Figure 7:
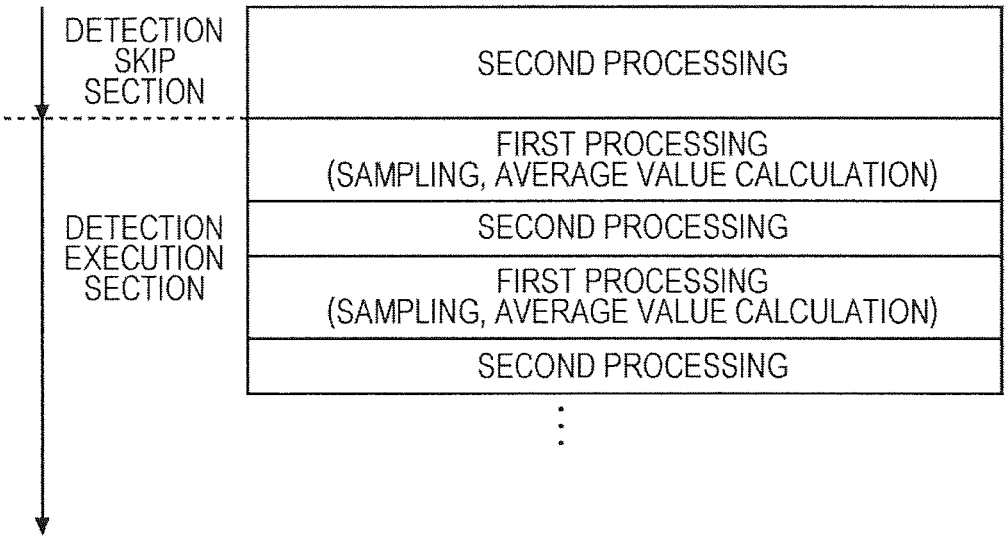
FIG. 7 is a diagram showing an example of processing in a detection execution section according to the embodiment.

The processing in the detection section T0 will be described with reference to FIG. 7. In the detection execution section, the control unit 1 alternately performs first processing and second processing. However, when the detection execution section occurs, the processing starts with the first processing. The time to perform the first processing is predetermined. The time to perform the second processing in the detection execution section is predetermined.

The first processing includes processing of charging the charge circuit 94 with electric charge. When performing the first processing, the control unit 1 turns off the switch 95. The first processing also includes processing of determining whether multi-feed has occurred based on the detection voltage V1. The control unit 1 recognizes (samples) the magnitude of the detection voltage V1 a plurality of times during the period of performing the first processing. For example, the control unit 1 recognizes the magnitude of the detection voltage V1 ten times at a predetermined cycle.

The control unit 1 determines whether multi-feed has occurred based on the magnitude of the detection voltage V1 having been recognized. For example, the control unit 1 calculates a determination numerical value based on the detection voltage V1 acquired a plurality of times. For example, the control unit 1 excludes the minimum value and the maximum value of the detection voltage V1 acquired during one execution period of the first processing. The control unit 1 calculates an average value of the remaining magnitudes of the detection voltage V1. The control unit 1 determines whether the calculated average value is equal to or smaller than a predetermined threshold value TH. When the calculated average value exceeds the threshold value TH, the control unit 1 determines that multi-feed has not occurred. When the calculated average value is equal to or less than the threshold value TH, the control unit 1 determines that multi-feed has occurred.

When multi-feed occurs, the amount (intensity) of the ultrasonic waves received by the reception unit 93 is lower than that when there is no multi-feed. The threshold value TH is determined based on the magnitude of the detection voltage V1 at the time of occurrence of multi-feed. For example, experiments are repeated a plurality of times to calculate a plurality of average values of the detection voltage V1 when no multi-feed occurs. For example, the threshold value TH can be set to a value smaller than the minimum value among the plurality of average values.

On the other hand, the second processing is processing of discharging the electric charge of the charge circuit 94. The control unit 1 keeps the switch 95 on during the period of the second processing. The control unit 1 continues discharging the charge circuit 94 for a certain period of time. The control unit 1 keeps the switch 95 turned on until the charge in the capacitor of the charge circuit 94 becomes zero (until reaching the ground level). The time to perform the second processing is, for example, several ten to several hundred microseconds or more (for example, 100 μs). When the time to perform the second processing has elapsed, the control unit 1 starts new first processing.

Here, the control unit 1 starts the first processing at the start time point of the detection execution section. As shown in FIG. 7, at the same time as the detection skip section ends, the control unit 1 starts the first processing. Therefore, the control unit 1 may maintain the switch 95 turned on (state of discharging the charge circuit 94) during the detection skip section.

The control unit 1 waits for the lapse of time from the timekeeping start time point to the lapse of the start time (Step #16). In other words, the control unit 1 waits until the start time point of the detection section T0. When the start time comes, the control unit 1 starts inputting a pulse to the transmission unit 92. As a result, transmission of an ultrasonic wave by the transmission unit 92 is started (Step #17).

The control unit 1 checks whether multi-feed has occurred (whether the average value is equal to or less than the threshold value TH) (Step #18). If multi-feed has occurred (Yes in Step #18), the control unit 1 stops the paper conveyance operation (Step #19). Note that the control unit 1 also ends the input of the pulse (transmission of the ultrasonic wave) to the transmission unit 92. Then, this flow ends (END).

If multi-feed has not occurred (No in Step #18), the control unit 1 checks whether the detection section T0 has ended (Step #110). If the detection section T0 ends (when the end time of the detection section T0 has come; Yes in Step #110), this flow ends (END). With the end of the detection section T0, the control unit 1 may end the input of the pulse (transmission of the ultrasonic wave) to the transmission unit 92. If the detection section T0 has not ended (No in Step #110), the flow returns to Step #18.

(Setting of Detection Skip Section)

Next, an example of the setting of the detection skip section according to the embodiment will be described based on FIG. 6 and FIGS. 8 to 11. The detection skip section is a section in which the detection voltage V1 decreases due to vibration applied to the conveyed paper. In other words, the detection skip section is a section in which it is possible that a decrease in the detection voltage V1 due to vibration is falsely detected as an occurrence of multi-feed. Based on the time point at which vibration is applied to the paper, the control unit 1 sets the detection skip section. The second section setting data D2 is defined based on the time when vibration is applied to the paper.

There are a plurality of factors by which and a plurality of time points at which vibration is applied to the paper while the paper is passing through the ultrasonic sensor 91. Therefore, it is possible to provide the plurality of detection skip sections in the detection section T0. The control unit 1 sets one or more of four types of detection skip section, i.e., a first detection skip section T1, a second detection skip section T2, a third detection skip section T3, and a fourth detection skip section T4.

The first detection skip section T1 is a detection skip section for coping with hit, against the conveyance guide 74, of the downstream end portion of the conveyed paper (paper head end) in the paper conveyance direction. The start time of the first detection skip section T1 is determined based on the time point at which the paper head end hits against the conveyance guide 74.

Figure 8:
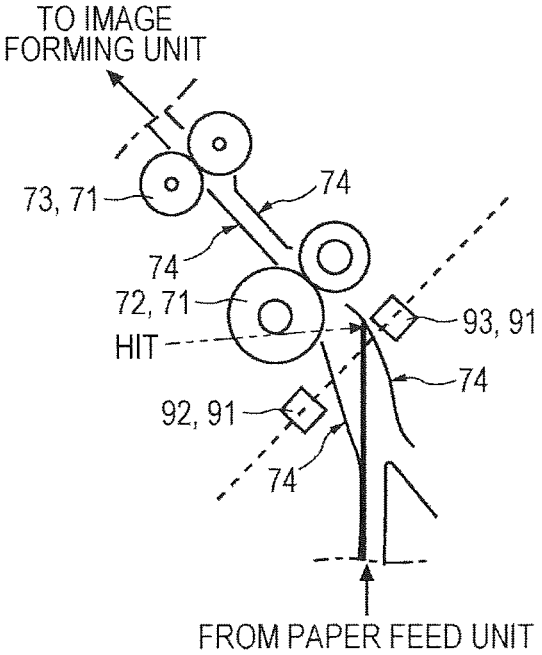
FIG. 8 is a view showing an example of hit of a head end of paper in the multifunction peripheral according to the embodiment.

FIG. 8 shows an example of hit of the paper head end against the conveyance guide 74. When the paper head end hits against the conveyance guide 74, a large vibration is transmitted to the paper. The vibration of the paper cancels out the ultrasonic wave emitted from the transmission unit 92. Among the detection skip sections shown in FIG. 6, the first one is the first detection skip section T1. The start time point of the first detection skip section T1 is also the end time point of the immediately preceding detection execution section.

For example, a period of time calculated by dividing the distance from the paper feed unit 6 to the conveyance guide 74 by the paper conveyance speed may be used as the start time of the first detection skip section T1. Alternatively, the start time of the first detection skip section T1 may be determined by experiment. In this case, a period of time from the timekeeping start time point to the time when the paper head end hits against the conveyance guide 74 is measured a plurality of times. The average value of the measured periods of time may be used as the start time of the first detection skip section T1. The control unit 1 starts the first detection skip section T1 at the time point when the start time of the first detection skip section T1 has elapsed from the timekeeping start time point. In the second section setting data D2, the start time of the first detection skip section T1 is determined for each combination pattern (type) of the paper size, the paper conveyance speed, and the paper type (thickness).

The end time of the first detection skip section T1 is also predetermined. The end time of the first detection skip section T1 can be determined based on experiment. For example, after hit of the paper head end against the conveyance guide 74, a period of time in which the detection voltage V1 is recovered to an extent that false detection does not occur is measured a plurality of times. In other words, after the hit, the period of time until the value of the detection voltage V1 records the threshold value TH is measured a plurality of times. The period of time is measured for each combination pattern of the paper size, the paper conveyance speed, and the paper type (thickness). For example, the end time of the first detection skip section T1 can be determined based on the average value of the periods of time calculated by experiment. Based on the measured period of time, a time interval from the start time to the end time is determined. The control unit 1 ends the first detection skip section T1 at the time point when the end time has elapsed from the timekeeping start time point. In the second section setting data D2, the end time of the first detection skip section T1 (start time of a new detection execution section) is determined for each combination pattern (type) of the paper size, the paper conveyance speed, and the paper type (thickness).

The second detection skip section T2 is a detection skip section for coping with rub of the downstream end portion of the conveyed paper (paper head end) in the paper conveyance direction against the conveyance guide 74 and hit thereof against the conveyance rotator 71 (pair of intermediate rollers 72). The conveyance rotator 71 is a rotator provided on the downstream side of the ultrasonic sensor 91 in the paper conveyance direction. The second detection skip section T2 is determined based on the time point at which the paper head end hits against the conveyance rotator 71. The second detection skip section T2 is determined so as to include a part of the time period in which the conveyed paper is rubbed against the conveyance guide 74.

Figure 9:
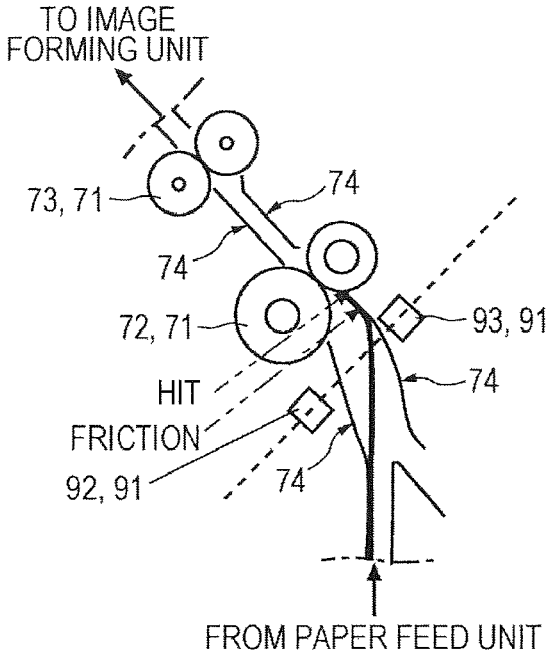
FIG. 9 is a view showing an example of hit of the head end of paper in the multifunction peripheral according to the embodiment.

FIG. 9 shows an example of rub of paper at the conveyance guide 74 and hit thereof against the pair of intermediate rollers 72. Compared with at the time of hit of the paper head end, vibration due to rub between the paper and the conveyance guide 74 is small. However, the vibration due to rub between the paper and the conveyance guide 74 is continuous. When the head end hits against the conveyance rotator 71 in the rubbed state, the vibration of the paper may be large. Among the detection skip sections shown in FIG. 6, the second one from the left is the second detection skip section T2. The start time of the second detection skip section T2 is also the end time of the immediately preceding detection execution section.

For example, a period of time is calculated by dividing the distance from the paper feed unit 6 to the pair of intermediate rollers 72 by the paper conveyance speed (period of time required to reach the pair of intermediate rollers). The calculated period of time may be used as the start time of the second detection skip section T2. Alternatively, in consideration of rub, a period of time shorter than the calculated period of time may be used as the start time of the second detection skip section T2. The control unit 1 starts the second detection skip section T2 at the time point when the determined start time has elapsed from the timekeeping start time point. In the second section setting data D2, the start time of the second detection skip section T2 is determined for each combination pattern (type) of the paper size, the paper conveyance speed, and the paper type (thickness).

The end time of the second detection skip section T2 is predetermined. For example, after the start of the second detection skip section T2, a period of time in which the detection voltage V1 is recovered to an extent that false detection does not occur is measured a plurality of times. In other words, after the hit, the period of time until the value of the detection voltage V1 records the threshold value TH is measured a plurality of times. Based on the period of time calculated in the experiment, the end time (time interval from the start time to the end time) of the second detection skip section T2 can be determined. The end time of the second detection skip section T2 is determined for each combination pattern (type) of the paper size, the paper conveyance speed, and the paper type (thickness). The control unit 1 ends the second detection skip section T2 at the time point when the end time of the second detection skip section T2 has elapsed from the timekeeping start time point. In the second section setting data D2, the end time of the second detection skip section T2 (start time of a new detection execution section) is determined for each combination pattern (type) of the paper size, the paper conveyance speed, and the paper type (thickness).

The third detection skip section T3 is a detection skip section for coping with hit, against the conveyance rotator 71 (pair of registration rollers 73), of the downstream end portion of the conveyed paper (paper head end) in the paper conveyance direction. The pair of registration rollers 73 is rotators provided on the downstream side of the ultrasonic sensor 91 in the paper conveyance direction. The start time of the third detection skip section T3 is determined based on the time point at which the paper head end hits against the pair of registration rollers 73. The start time of the third detection skip section T3 is also the end time of the immediately preceding detection execution section.

Figure 10:
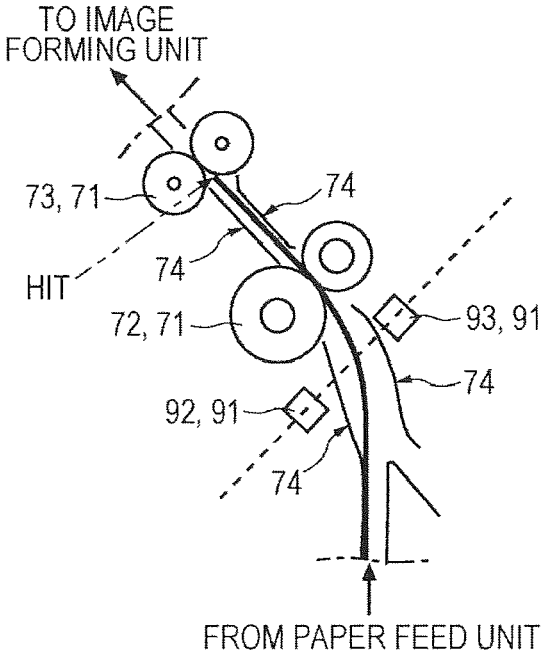
FIG. 10 is a view showing an example of hit of the head end of paper in the multifunction peripheral according to the embodiment.

FIG. 10 shows an example of hit of the paper head end against the pair of registration rollers 73. When the paper head end reaches the registration rollers 73, the control unit 1 is holding the pair of registration rollers 73 at rest. The paper head end is thrust against the pair of registration rollers 73. Therefore, when the paper head end hits against the pair of registration rollers 73, a large vibration may be transmitted to the paper. The vibration of the paper cancels out the ultrasonic wave emitted from the transmission unit 92. Among the detection skip sections shown in FIG. 6, the third one from the left is the third detection skip section T3.

For example, a period of time that results from dividing the distance from the paper feed unit 6 to the pair of registration rollers 73 by the paper conveyance speed (period of time required to reach the pair of registration rollers) is calculated. The calculated period of time may be used as the start time of the third detection skip section T3. The control unit 1 starts the third detection skip section T3 at the time point when the start time of the third detection skip section T3 has elapsed from the timekeeping start time point. In the second section setting data D2, the start time of the third detection skip section T3 is determined for each combination pattern (type) of the paper size, the paper conveyance speed, and the paper type (thickness).

The end time of the third detection skip section T3 is predetermined. For example, after the start of the third detection skip section T3, a period of time in which the detection voltage V1 is recovered to an extent that false detection does not occur is measured a plurality of times. That is, after the hit, the period of time until the value of the detection voltage V1 records the threshold value TH is measured a plurality of times. The end time (time interval from the start time to the end time) of the third detection skip section T3 can be determined based on the period of time (for example, the average value) calculated by experiment. The end time of the third detection skip section T3 is determined for each combination pattern (type) of the paper size, the paper conveyance speed, and the paper type (thickness). The control unit 1 ends the third detection skip section T3 at the time point when the determined end time has elapsed from the timekeeping start time point. In the second section setting data D2, the end time of the third detection skip section T3 (start time of a new detection execution section) is determined for each combination pattern (type) of the paper size, the paper conveyance speed, and the paper type (thickness).

The paper tail end may bounce when released from the end portion of the conveyance guide 74. Due to this bounce, the paper tail end may collide against a portion of the conveyance guide 74. The fourth detection skip section T4 is a detection skip section for coping with hit, against the conveyance guide 74, of the upstream end portion of the conveyed paper (paper tail end) in the paper conveyance direction. The start time of the fourth detection skip section T4 corresponds to the time point at which the upstream end portion of the conveyed paper in the paper conveyance direction released from the end portion of the conveyance guide 74 and bounced off hits against another portion of the conveyance guide 74.

Figure 11:
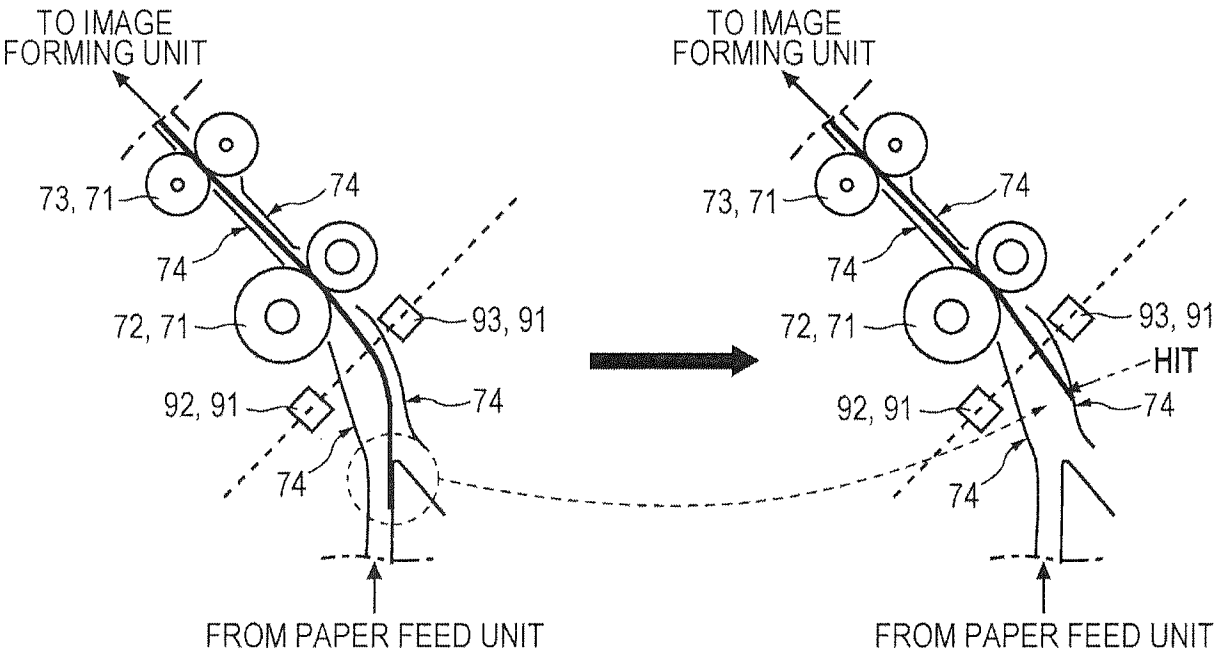
FIG. 11 is a view showing an example of hit of a tail end of paper in the multifunction peripheral according to the embodiment.

Bounce and hit of the paper tail end will be described with reference to FIG. 11. In the multifunction peripheral 100, the conveyance path is curved. As shown in the left drawing of FIG. 11, the paper is conveyed while being bent in the multifunction peripheral 100. In the multifunction peripheral 100, the end portion of the conveyance guide 74 is positioned on the upstream side of the ultrasonic sensor 91 in the paper conveyance direction. Once the paper tail end leaves the bend, there is no wall to suppress the bend (elasticity) of the paper. As a result, the paper tail end may bounce as shown in the right drawing of FIG. 11. The bounced paper tail end may collide against another portion of the conveyance guide 74. When the paper tail end hits against the conveyance guide 74, a large vibration is transmitted to the paper. The vibration of the paper cancels out the ultrasonic wave emitted from the transmission unit 92. Among the detection skip sections shown in FIG. 6, the last one is the fourth detection skip section T4. The start time of the fourth detection skip section T4 is also the end time of the immediately preceding detection execution section.

For example, a period of time is calculated by dividing the distance from the paper feed unit 6 to the end portion of the conveyance guide 74 by the paper conveyance speed. The calculated period of time may be used as the start time of the fourth detection skip section T4. Also, the start time of the fourth detection skip section T4 may be determined by experiment. For example, a period of time from the timekeeping start time point until the paper tail end hits against the conveyance guide 74 is measured a plurality of times. The average value of the periods of time measured from the timekeeping start time point may be used as the start time of the fourth detection skip section T4. The control unit 1 starts the fourth detection skip section T4 at the time point when the start time of the fourth detection skip section T4 has elapsed from the timekeeping start time point. In the second section setting data D2, the start time of the fourth detection skip section T4 is determined for each combination pattern (type) of the paper size, the paper conveyance speed, and the paper type (thickness).

The end time of the fourth detection skip section T4 is predetermined. After the start of the fourth detection skip section T4, a period of time in which the detection voltage V1 is recovered to an extent that false detection does not occur is measured a plurality of times. That is, after the hit, the period of time until the value of the detection voltage V1 records the threshold value TH is measured a plurality of times. The end time (time interval from the start time to the end time) of the fourth detection skip section T4 can be determined based on the period of time (for example, the average value) calculated by experiment. The end time (time interval from the start time to the end time) of the fourth detection skip section T4 is determined for each combination pattern (type) of the paper size, the paper conveyance speed, and the paper type (thickness). The control unit 1 ends the fourth detection skip section T4 at the time point when the end time of the fourth detection skip section T4 has elapsed from the timekeeping start time point. In the second section setting data D2, the end time of the fourth detection skip section T4 (start time of a new detection execution section) is determined for each combination pattern (type) of the paper size, the paper conveyance speed, and the paper type (thickness).

(Setting of Section Corresponding to Paper Size)

Next, an example of setting of the detection execution section and the detection skip section corresponding to the paper size will be described with reference to FIG. 12. There is a plurality of paper sizes that can be used in the multifunction peripheral 100. Depending on the paper size, the period of time in which vibration is applied to the paper varies. Therefore, the detection execution section and the detection skip section may be set depending on the paper size.

Figure 12:
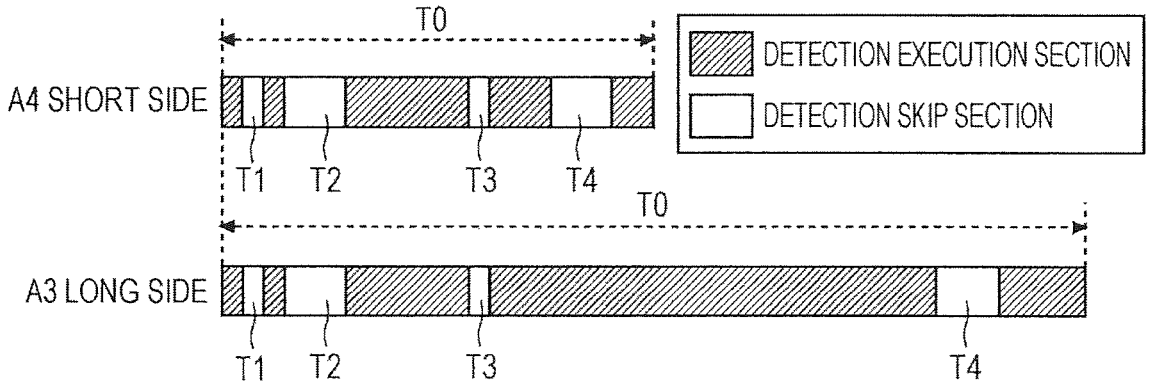
FIG. 12 is a chart showing an example of setting of a detection skip section according to the embodiment.

FIG. 12 shows an example of setting of the detection skip section corresponding to the paper size. In FIG. 12, the upper chart shows an example of the detection section T0 at the time of conveying a sheet of paper having the length of the A4 short side in the paper conveyance direction. The lower chart of FIG. 12 shows an example of the detection section T0 at the time of conveying a sheet of paper having the length of the A3 long side in the paper conveyance direction. Note that the length of the A3 long side is twice the length of the A4 short side.

In a case where the paper conveyance speed is the same, even if the paper size is different, the time point at which the paper head end hits against the conveyance guide 74 and the conveyance rotator 71 does not vary. Thus, in a case where the paper conveyance speed and the paper type are the same, the control unit 1 may set the start time points of the first detection skip section T1, the second detection skip section T2, and the third detection skip section T3 to be the same.

In a case where the paper conveyance speed is the same, on the other hand, the hit time point at the paper tail end varies if the paper size is different. This is because the time point of passing through the end portion of the conveyance guide 74 varies. Therefore, in a case where the paper conveyance speed and the paper type are the same, the control unit 1 may set the start time of the fourth detection skip section T4 as a time corresponding to the paper size. In this way, the control unit 1 may set the detection execution section and the detection skip section depending on the paper size. The second section setting data D2 may be defined so that the start time point of the detection skip section varies in a combination pattern (type) in which the paper conveyance speed and the paper type are the same but the paper size is different.

(Setting of Section Corresponding to Paper Type)

Next, an example of setting of the detection execution section and the detection skip section corresponding to the paper type will be described with reference to FIG. 13. In the multifunction peripheral 100, sheets of paper having various thicknesses can be used. The ease of transmission of vibration, the magnitude of vibration, and the ease of bounce vary depending on the paper thickness. Therefore, the detection execution section and the detection skip section may be set depending on the paper type (paper thickness).

Figure 13:
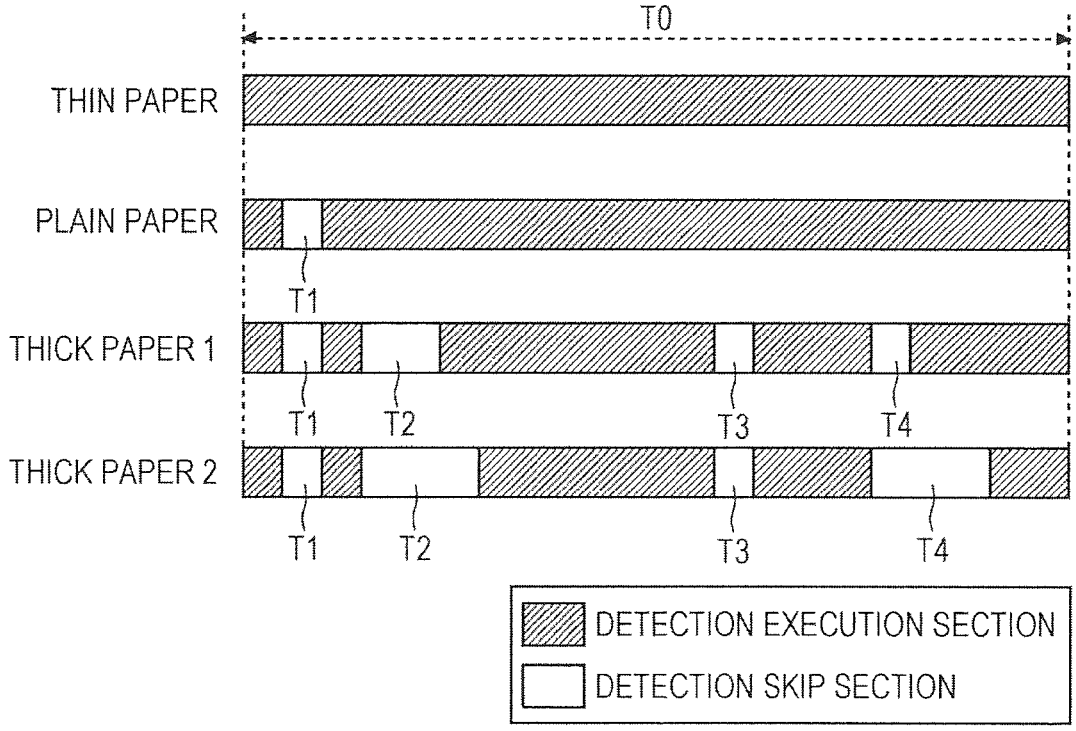
FIG. 13 is a chart showing an example of setting of the detection skip section according to the embodiment.

FIG. 13 shows an example of setting of the detection skip section corresponding to the paper type. In FIG. 13, the uppermost row shows an example of the detection section T0 of thin paper, the second row shows an example of the detection section T0 of plain paper, the third row shows an example of the detection section T0 of thick paper 1, and the last row shows an example of the detection section T0 of thick paper 2.

In a case where the paper conveyance speed and the paper size are the same, even if the thickness is different, the time point at which hit or bounce occurs basically does not vary.

On the other hand, the ease of transmission (rigidity) of vibration, the ease of bounce (elasticity), and the ease of propagation vary depending on the thickness. The length of the period in which there is a risk of false detection of multi-feed (attenuation rate of vibration) varies depending on the paper thickness. In general, the thinner the paper is, the faster the vibration due to shock attenuates. Therefore, in a case where the size and the conveyance speed of the conveyed paper are the same, the control unit 1 may lengthen the detection skip section as the conveyed paper is thicker. Further, the control unit 1 may shorten the detection skip section as the conveyed paper is thinner. In this way, the second section setting data D2 may be defined so that the length of the detection skip section varies in a combination pattern (type) in which the paper conveyance speed and the paper size are the same but the paper type is different.

FIG. 13 shows an example in which the detection skip section is not provided with respect to the thin paper. FIG. 13 shows an example in which only the first detection skip section T1 is provided with respect to the plain paper. FIG. 13 shows an example in which the number of detection skip sections is increased and the total time of the detection skip sections is increased for the thick paper 1 as compared to the thin paper and the plain paper. FIG. 13 shows an example in which the number of detection skip sections is increased for the thick paper 2 as compared to the thin paper and the plain paper, and the total time of the detection skip sections is increased for the thick paper 2 as compared to the thin paper, the plain paper, and the thick paper 1. The control unit 1 may shorten the detection skip section as the paper is thinner and lengthen the detection skip section as the paper is thicker.

(Setting of Section Corresponding to Conveyance Speed)

Next, an example of setting of the detection execution section and the detection skip section corresponding to the conveyance speed will be described with reference to FIG. 14. The paper conveyance speed of the multifunction peripheral 100 is multi-level. In general, the higher the speed is, the larger the shock at the time of hit is. Therefore, the higher the paper conveyance speed is, the larger the shock applied to the paper at the time of hit of the head end or the tail end. Therefore, the detection execution section and the detection skip section may be set depending on the paper conveyance speed.

Figure 14:
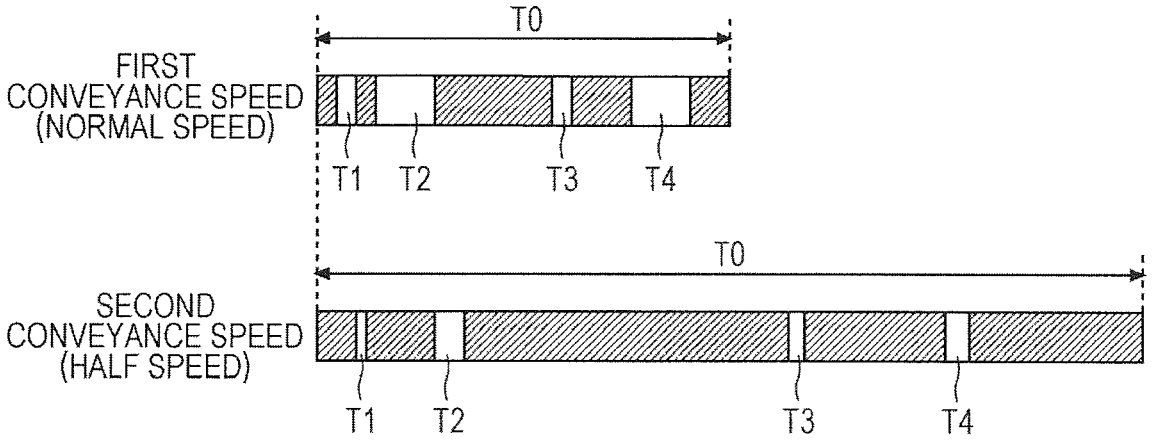
FIG. 14 is a chart showing an example of setting of the detection skip section according to the embodiment.

FIG. 14 shows an example of setting of the detection skip section corresponding to the conveyance speed. In FIG. 14, the upper chart shows an example of the detection section T0 in the case of the first conveyance speed (normal speed). The lower chart of FIG. 14 shows an example of the detection section T0 in the case of the second conveyance speed (half the normal speed).

If the paper conveyance speed is different although the paper size is the same, the time of hit and the magnitude of vibration at the time point when the paper end portion hits. Therefore, if the type and the size of the conveyed paper are the same, the control unit 1 increases the proportion (increases the period of time) of the detection skip section in the detection section T0 as the paper conveyance speed is higher. On the other hand, the control unit 1 decreases the proportion (decreases the period of time) of the detection skip section in the detection section T0 as the paper conveyance speed is lower. The second section setting data D2 may be defined so that the ratio of the total time of the detection skip section to the entire length of the detection section T0 varies in a combination pattern (type) in which the paper size and the paper type are the same but the paper conveyance speed is different.

The paper may vibrate due to hit against the conveyance guide 74 or the conveyance rotator 71, for example. Vibration may propagate on the paper, canceling out or diffusing the ultrasonic wave. The ultrasonic wave reaching the reception unit 93 may be reduced due to shock (vibration) on the paper. Even if only one sheet of paper is conveyed, the reception level (intensity) of the ultrasonic wave may drop to a level close to that during multi-feed. As a result, multi-feed occurrence may be falsely detected.

Therefore, the multifunction peripheral 100 (paper conveyance device) according to the embodiment includes the paper feed unit 6, the conveyance rotator 71, the conveyance guide 74, the multi-feed detection unit 9, and the control unit 1. The paper feed unit 6 accommodates and supplies paper. The conveyance rotator 71 conveys the paper. The conveyance guide 74 guides the conveyed paper. The multi-feed detection unit 9 includes the ultrasonic sensor 91 and the charge circuit 94. The detection voltage V1, which is the output of the multi-feed detection unit 9, is input into the control unit 1. The ultrasonic sensor 91 includes a transmission unit 92 and a reception unit 93. The transmission unit 92 transmits an ultrasonic wave. The reception unit 93 outputs an electric charge corresponding to the level of the received ultrasonic wave. The transmission unit 92 and the reception unit 93 are provided on the paper conveyance path so that the paper is conveyed between the transmission unit 92 and the reception unit 93. The charge circuit 94 outputs, as the detection voltage V1, a voltage obtained by storing the electric charge output by the reception unit 93. The control unit 1 sets the detection section T0 in which the transmission unit is caused to transmit an ultrasonic wave for each sheet of conveyed paper. In the detection section T0, the control unit 1 causes the transmission unit 92 to transmit an ultrasonic wave of a predetermined cycle. The control unit 1 sets the detection execution section and the detection skip section in the detection section T0. In the detection execution section, the control unit 1 determines whether multi-feed is occurring based on the detection voltage V1. In the detection skip section, the control unit 1 does not determine whether multi-feed has occurred based on the detection voltage V1. The control unit 1 sets the detection skip section based on a time point at which vibration is applied to the conveyed paper.

In a period in which false detection of multi-feed can occur due to hit or rub against a member (detection skip section), it is not determined whether multi-feed has occurred. Even if the ultrasonic wave arriving at the reception unit 93 temporarily attenuates due to the vibration of the paper, false determination as multi-feed is not made. It is possible to determine whether multi-feed has occurred correctly while considering the vibration applied to the paper.

The multi-feed detection unit 9 includes the switch 95 for removing (discharging) the electric charge of the charge circuit 94. In the detection execution section, the control unit 1 alternately performs first processing and second processing. When performing the first processing, the control unit 1 charges the charge circuit 94 with the switch 95 turned off and acquires the detection voltage V1. When performing the second processing, the control unit 1 discharges the charge circuit 94 with the switch 95 turned on. The control unit 1 completes the discharge of the charge circuit 94 with the switch 95 turned on prior to the time point of switching from the detection skip section to the detection execution section. The first processing is started at the time point when the detection section becomes the detection execution section. It is possible to cause the start time of the first processing (end time of the second processing, and the end time of discharge of the charge circuit 94) and the start time of the detection execution section to coincide. The discharge period of the charge circuit 94 and the start time of the detection execution section do not overlap. It is possible to start the determination as to whether multi-feed is occurring in accordance with the start time of the detection execution section. There is no omission or delay in detection of multi-feed.

The control unit 1 sets the start time of the detection skip section based on the time point at which the downstream end portion of the conveyed paper in the paper conveyance direction hits against the conveyance guide 74. The downstream end portion (paper head end) in the paper conveyance direction may hit the conveyance guide 74. The time period in which false detection of multi-feed can occur due to hit can be set to the detection skip section. It is possible to eliminate false detection of multi-feed due to hit of the downstream end portion.

The control unit 1 includes, in the detection skip section, a part of the time period in which the conveyed paper is rubbed against the conveyance guide 74. False detection of multi-feed may occur due to vibration caused by rub between the conveyed paper and the conveyance guide 74. The time period in which false detection of multi-feed can occur due to rub can be set to the detection skip section. It is possible to eliminate false detection of multi-feed due to rub.

The control unit 1 sets the start time of the detection skip section based on the time point at which the downstream end portion of the conveyed paper in the paper conveyance direction hits against the conveyance rotator 71 that is on the downstream side of the ultrasonic sensor 91 in the paper conveyance direction. The downstream end portion (paper head end) in the paper conveyance direction may hit the conveyance rotator 71 (roller). The time period in which false detection of multi-feed can occur due to hit can be set to the detection skip section. It is possible to eliminate false detection of multi-feed due to hit of the downstream end portion.

The control unit 1 sets the start time of the detection skip section based on the time point at which the upstream end portion of the conveyed paper in the paper conveyance direction is released from the end portion of the conveyance guide 74 to bounce and thus hits against another conveyance guide 74. When the upstream end portion (paper tail end) in the paper conveyance direction is separated from the end portion of the conveyance guide 74, the upstream end portion may thrust against the conveyance guide 74 due to the elasticity of the paper. The time period in which false detection of multi-feed can occur due to hit at the upstream end portion can be set to the detection skip section. It is possible to eliminate false detection of multi-feed due to hit of the upstream end portion.

The control unit 1 recognizes the size of the conveyed paper. The control unit 1 sets the detection execution section and the detection skip section depending on the paper size. It is possible to appropriately set the detection execution section and the detection skip section depending on the paper size.

In a case where the size and the conveyance speed of the conveyed paper are the same, the thinner the conveyed paper is, the smaller the vibration becomes when the paper hits against the conveyance guide 74 and the conveyance rotator 71. Since the thin paper is easy to bend, the thin paper is more likely to absorb vibration than the thick paper. The thinner the conveyed paper is, the easier the conveyed paper transmits the ultrasonic wave. Even if vibration is applied, the thinner the paper is, the shorter the period of time is in which vibration large enough to cause false detection of multi-feed remains. Therefore, the control unit 1 recognizes the type of the conveyed paper. In a case where the size and the conveyance speed of the conveyed paper are the same, the control unit 1 lengthens the detection skip section as the conveyed paper is thicker and shortens the detection skip section as the conveyed paper is thinner. The detection skip section can be set depending on the paper thickness. Specifically, it is possible to make the detection skip section for the thin paper shorter than the detection skip section for the thick paper. It is possible to make the detection execution section as long as possible. It is possible to make the detection skip section for the thick paper longer than the detection skip section for the thin paper. It is possible to eliminate false detection of multi-feed.

At the time of hit at a high speed, the vibration of the paper becomes larger than that at the time of hit at a low speed. It is preferable to increase the proportion of the detection skip section in the detection section T0 as the conveyance speed is higher. Therefore, in a case where the type and the size of the conveyed paper are the same, the control unit 1 increases the proportion of the detection skip section in the detection section T0 as the paper conveyance speed is higher and decreases the proportion of the detection skip section in the detection section T0 as the paper conveyance speed is lower. It is possible to set the detection skip section depending on the paper conveyance speed. It is possible to reduce false detection of multi-feed regardless of whether the conveyance speed is high or low.

If the detection execution section is too short, it may be impossible to determine appropriately whether multi-feed occurs. Therefore, when the detection execution section between the detection skip sections is shorter than a predetermined minimum time, the control unit 1 may change the detection execution section shorter than the minimum time to the detection skip section and thus integrate the plurality of detection skip sections. The detection execution section that is too short can be changed to the detection skip section. The detection execution section that may not allow appropriate determination can be replaced with the detection skip section. It is possible to eliminate false detection of multi-feed occurrence.

The control unit 1 does not include the start time point and the end time point of the detection section T0 in the detection skip section. It is possible to accurately detect occurrence of multi-feed where the end portions of the paper overlap (accompaniment multi-feed, i.e., multi-feed where the overlapping portion is short).

While the embodiment of the present disclosure has been described above, the scope of the present disclosure is not limited thereto, and various modifications can be made without departing from the spirit of the disclosure.

What is claimed is:

1. A paper conveyance device comprising:

a paper feed unit that accommodates and supplies paper;

a conveyance rotator that conveys the paper;

a conveyance guide that guides the conveyed paper;

a multi-feed detection unit that includes an ultrasonic sensor, a charge circuit, and a switch; and a control unit into which a detection voltage that is an output of the multi-feed detection unit is input, wherein the ultrasonic sensor includes a transmission unit and a reception unit, the transmission unit transmits an ultrasonic wave, the reception unit outputs an electric charge corresponding to a level of a received ultrasonic wave, the transmission unit and the reception unit are provided on a paper conveyance path such that the paper is conveyed between the transmission unit and the reception unit, the charge circuit outputs, as the detection voltage, a voltage obtained by storing the electric charge output by the reception unit, the switch removes an electric charge of the charge circuit, and the control unit sets, for each sheet of the conveyed paper, a detection section in which the transmission unit is caused to transmit an ultrasonic wave, causes the transmission unit to transmit an ultrasonic wave in the detection section, sets a detection execution section and a detection skip section in the detection section, determines whether multi-feed is occurring based on the detection voltage in the detection execution section, does not determine whether multi-feed has occurred based on the detection voltage in the detection skip section, sets the detection skip section based on a time point at which vibration is applied to the conveyed paper, alternately performs first processing and second processing in the detection execution section, charges the charge circuit with the switch turned off and acquires the detection voltage when performing the first processing, discharges the charge circuit with the switch turned on when performing the second processing, completes discharge of the charge circuit with the switch turned on prior to a time point of switching from the detection skip section to the detection execution section, and starts the first processing at a time point at which the detection section becomes the detection execution section.

2. The paper conveyance device according to claim 1, wherein the control unit excludes a minimum value and a maximum value of the detection voltage acquired during one execution period of the first processing, determines that multi-feed has not occurred when an average value of remaining magnitudes of the detection voltage exceeds a predetermined threshold value, and determines that multi-feed has occurred when the average value is equal to or less than the threshold value.

3. The paper conveyance device according to claim 1, wherein the control unit includes, in the detection skip section, a part of a time period in which the conveyed paper is rubbed against the conveyance guide.

4. The paper conveyance device according to claim 1, wherein the control unit sets a start time of the detection skip section based on a time point at which a downstream end portion of the conveyed paper in a paper conveyance direction hits against the conveyance rotator that is on a downstream side of the ultrasonic sensor in the paper conveyance direction.

5. The paper conveyance device according to claim 1, wherein the control unit sets a start time of the detection skip section based on a time point at which an upstream end portion of the conveyed paper in a paper conveyance direction is released from an end portion of the conveyance guide to bounce and hits against the conveyance guide.

6. The paper conveyance device according to claim 1, wherein the control unit recognizes a size of the conveyed paper, and sets the detection execution section and the detection skip section depending on the size of the paper.

7. The paper conveyance device according to claim 1, wherein the control unit recognizes a type of the conveyed paper, and lengthens the detection skip section as the conveyed paper is thicker and shortens the detection skip section as the conveyed paper is thinner, in a case where a size and a conveyance speed of the conveyed paper are same.

8. A paper conveyance device comprising:

a paper feed unit that accommodates and supplies paper;

a conveyance rotator that conveys the paper;

a conveyance guide that guides the conveyed paper;

a multi-feed detection unit that includes an ultrasonic sensor and a charge circuit; and a control unit into which a detection voltage that is an output of the multi-feed detection unit is input, wherein the ultrasonic sensor includes a transmission unit and a reception unit, the transmission unit transmits an ultrasonic wave, the reception unit outputs an electric charge corresponding to a level of a received ultrasonic wave, the transmission unit and the reception unit are provided on a paper conveyance path such that the paper is conveyed between the transmission unit and the reception unit, the charge circuit outputs, as the detection voltage, a voltage obtained by storing the electric charge output by the reception unit, and the control unit sets, for each sheet of the conveyed paper, a detection section in which the transmission unit is caused to transmit an ultrasonic wave, causes the transmission unit to transmit an ultrasonic wave in the detection section, sets a detection execution section and a detection skip section in the detection section, determines whether multi-feed is occurring based on the detection voltage in the detection execution section, does not determine whether multi-feed has occurred based on the detection voltage in the detection skip section, sets the detection skip section based on a time point at which vibration is applied to the conveyed paper, and sets a start time of the detection skip section based on a time point at which a downstream end portion of the conveyed paper in a paper conveyance direction hits against the conveyance guide.

9. The paper conveyance device according to claim 8, wherein the multi-feed detection unit includes a switch that removes an electric charge of the charge circuit, and the control unit alternately performs first processing and second processing in the detection execution section, charges the charge circuit with the switch turned off and acquires the detection voltage when performing the first processing;

discharges the charge circuit with the switch turned on when performing the second processing, completes discharge of the charge circuit with the switch turned on prior to a time point of switching from the detection skip section to the detection execution section, and starts the first processing at a time point at which the detection section becomes the detection execution section.

10. The paper conveyance device according to claim 8, wherein the control unit excludes a minimum value and a maximum value of the detection voltage acquired during one execution period of the first processing, determines that multi-feed has not occurred when an average value of remaining magnitudes of the detection voltage exceeds a predetermined threshold value, and determines that multi-feed has occurred when the average value is equal to or less than the threshold value.

11. The paper conveyance device according to claim 8, wherein the control unit includes, in the detection skip section, a part of a time period in which the conveyed paper is rubbed against the conveyance guide.

12. The paper conveyance device according to claim 8, wherein the control unit sets a start time of the detection skip section based on a time point at which a downstream end portion of the conveyed paper in a paper conveyance direction hits against the conveyance rotator that is on a downstream side of the ultrasonic sensor in the paper conveyance direction.

13. The paper conveyance device according to claim 8, wherein the control unit sets a start time of the detection skip section based on a time point at which an upstream end portion of the conveyed paper in a paper conveyance direction is released from an end portion of the conveyance guide to bounce and hits against the conveyance guide.

14. The paper conveyance device according to claim 8, wherein the control unit recognizes a size of the conveyed paper, and sets the detection execution section and the detection skip section depending on the size of the paper.

15. The paper conveyance device according to claim 8, wherein the control unit recognizes a type of the conveyed paper, and lengthens the detection skip section as the conveyed paper is thicker and shortens the detection skip section as the conveyed paper is thinner, in a case where a size and a conveyance speed of the conveyed paper are same.

16. A method of controlling a paper conveyance device, the method comprising:

supplying paper from a paper feed unit that accommodates the paper;

conveying the paper using a conveyance rotator;

guiding the conveyed paper using a conveyance guide;

providing a transmission unit and a reception unit of an ultrasonic sensor on a paper conveyance path such that paper is conveyed between the transmission unit and the reception unit;

using, as the detection voltage, a voltage obtained by storing an electric charge output from the reception unit corresponding to a level of an ultrasonic wave received by the charge circuit;

removing an electric charge of the charge circuit using the switch;

setting, for each sheet of the conveyed paper, a detection section in which the transmission unit is caused to transmit an ultrasonic wave;

causing the transmission unit to transmit an ultrasonic wave in the detection section;

setting a detection execution section and a detection skip section in the detection section;

determining whether multi-feed is occurring based on the detection voltage in the detection execution section;

skipping determining whether multi-feed has occurred based on the detection voltage in the detection skip section;

setting the detection skip section based on a time point at which vibration is applied to the conveyed paper;

alternately performing first processing and second processing in the detection execution section;

charging the charge circuit with the switch turned off and acquiring the detection voltage when performing the first processing;

discharging the charge circuit with the switch turned on when performing the second processing;

completing discharge of the charge circuit with the switch turned on prior to a time point of switching from the detection skip section to the detection execution section; and starting the first processing at a time point at which the detection section becomes the detection execution section.

* * * * *